US007460645B2

(12) United States Patent
Anno

(10) Patent No.: US 7,460,645 B2
(45) Date of Patent: Dec. 2, 2008

(54) X-RAY TUBE

(75) Inventor: Hidero Anno, Otawara (JP)

(73) Assignees: Toshiba Electron Tubes & Devices Co., Ltd., Tochigi-ken (JP); Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/806,013

(22) Filed: May 29, 2007

(65) Prior Publication Data

US 2007/0230663 A1 Oct. 4, 2007

Related U.S. Application Data

(63) Continuation of application No. PCT/JP2006/316722, filed on Aug. 25, 2006.

(30) Foreign Application Priority Data

Aug. 29, 2005 (JP) ..... 2005-248202
Aug. 24, 2006 (JP) ..... 2006-227555

(51) Int. Cl.
*H01J 35/00* (2006.01)
*H01J 35/18* (2006.01)
*H01J 35/12* (2006.01)

(52) U.S. Cl. ..... 378/141; 378/119; 378/140

(58) Field of Classification Search ..... 378/119, 378/121, 125, 130, 132, 137, 138, 140, 141, 378/194

See application file for complete search history.

(56) References Cited

U.S. PATENT DOCUMENTS 2,679,017 A * 5/1954 Rogers et al. ..... 378/136
2,886,725 A * 5/1959 Yanagisawa ..... 378/136
5,506,881 A * 4/1996 Ono et al. ..... 378/125
2004/0032929 A1* 2/2004 Andrews et al. ..... 378/119
2005/0069087 A1* 3/2005 Kendall ..... 378/119

FOREIGN PATENT DOCUMENTS

| | | |
|---|---|---|
| JP | 38-20901 | 10/1963 |
| JP | 62-5546 | 1/1987 |
| JP | 62-64948 U | 1/1987 |
| JP | 1-32720 Y2 | 10/1989 |
| JP | 6-84490 | 3/1994 |
| JP | 2001-504988 | 4/2001 |
| JP | 2004-207053 | 7/2004 |

OTHER PUBLICATIONS

International Search Report dated Oct. 3, 2006 for PCT/JP2006/316722 Filed Aug. 25, 2006.

* cited by examiner

*Primary Examiner*—Edward J Glick
*Assistant Examiner*—Mona M Sanei
(74) *Attorney, Agent, or Firm*—Pillsbury Winthrop Shaw Pittman, LLP

(57) ABSTRACT

A supporting member supports an anode target at one end thereof and is provided with an attachment portion around the outer circumference of the other end. The attachment portion is attached to the inner circumferential surface of the cylindrical portion of the second vacuum envelope member so that the heat conductivity from the supporting member to the second vacuum envelope member can be improved by means of the attachment portion. A terminal is provided at the end surface portion on the side of the other end of the second vacuum envelope member for applying a voltage to the anode target. The terminal is positioned away from the attachment portion so that the temperature of the insulating material that insulates the terminal can be kept low and the insulating characteristics can be ensured over the long term.

14 Claims, 14 Drawing Sheets

X-RAY TUBE

CROSS-REFERENCE TO RELATED APPLICATIONS

This is a Continuation Application of PCT application No. PCT/JP2006/316722, filed Aug. 25, 2006, which was published under PCT Article 21(2) in Japanese.

This application is based upon and claims the benefit of priority from prior Japanese Patent Applications No. 2005-248202, filed Aug. 29, 2005; and No. 2006-227555, filed Aug. 24, 2006, the entire contents of both of which are incorporated herein by reference.

BACKGROUND OF THE INVENTION

1. Field of the Invention

The present invention relates to an X-ray tube, and more specifically to a fixed-anode-type X-ray tube whose anode is fixed.

2. Description of the Related Art

In conventional technologies, typical X-ray tubes include a fixed-anode-type X-ray tube. In the fixed-anode-type X-ray tube, electrons are generated by a filament of its cathode. These electrons are accelerated toward the anode target by a high-voltage electric field, and the high-energy electrons collide with the anode target to produce X-rays.

Heat is generated when the high-energy electrons collide with the anode target. The fixed-anode-type X-ray tube is provided with a cooling system of an insulating oil immersion type, a liquid forced cooling type, an air forced cooling type or the like in order to dissipate the generated heat into the outside.

In an X-ray tube of the insulating oil immersion type, a cathode assembly and an anode assembly are vacuum-sealed in an outer glass casing. The vacuum envelope is arranged inside a housing that is filled with insulating oil. The insulating oil serves as an electrical isolator and also as an absorber of heat generated in the anode assembly. The heat absorbed by the insulating oil is dissipated through the outer wall of the housing into the air.

In addition, as disclosed in Jpn. UM Appln. KOKOKU Publication No. H1-32720, for example, an anode target in an X-ray tube of a liquid forced cooling type is supported by a cylindrical anode supporting member. A cooling path is constituted by the inner space of the anode supporting member, through which a cooling liquid can flow to cool the anode portion.

Furthermore, as disclosed in Jpn. PCT National Publication No. 2001-504988, in an X-ray tube of an air forced cooling type, a vacuum envelope is constituted by an outer vacuum casing provided at one end thereof and an outer insulating casing provided at the other end. The anode supporting member has one end supporting the anode target and the other end extending from the other end of the outer insulating casing to the outside. A lead for supplying a high voltage to the anode target is connected to the other end of this anode supporting member. The outer surface of the outer insulating casing and the other end of the anode supporting member are wrapped with a potting material, namely molded material. For the purpose of cooling the anode portion, air is forced to travel outside the potting material.

BRIEF SUMMARY OF THE INVENTION

A conventional X-ray tube of an insulating oil immersion type requires a housing that is larger than X-ray tubes of other cooling systems do. Introduction of the insulating oil immersion type is an obstacle to miniaturizing the X-ray tube. Furthermore, the use of insulating oil in the insulating oil immersion type makes it difficult to assemble, repair, and disposal of the X-ray tube.

In addition, a conventional X-ray tube of a forced liquid cooling type utilizes an insulating oil and purified water as an insulating liquid that serves as a cooling liquid to cool the anode portion. This requires a closed-loop cooling system including a heat exchanger, circulating pump and hose specifically designed for the system. As a result, the cost is increased, and reliability is lowered. Especially when purified water is used, a filter formed of a special ion exchanging resin is required in order to prevent the electric conductivity of purified water from increasing during the use. Because such a filter is needed, problems of a labor of maintenance and management and increased cost arise.

Moreover, the above problems in the insulating oil immersion type and the forced liquid cooling type do not reside in an X-ray tube of a forced air cooling type. However, the forced liquid cooling type does not have sufficient thermal dissipation characteristics because heat is conducted from the anode supporting member to the potting material, which is low in heat conductivity. Thus, there is a problem that the heat load of the anode target is not sufficiently reduced. Furthermore, the heat dissipating member that dissipates heat from the anode supporting member to the potting material is arranged in the vicinity of the high-voltage supplying member to which a high-voltage supplying lead is connected. Insufficient thermal dissipation increases the temperature of the potting material, creating a problem that the electrical insulating function of the potting material is degraded at a relatively early stage.

The purpose of the present invention is to offer an X-ray tube that maintains excellent heat dissipating characteristics and ensures the insulating characteristics over the long term.

According to an aspect of the present invention, there is provided an X-ray tube comprising: a cylindrical vacuum envelope including a first vacuum envelope member formed at one end and provided with an output window through which X-rays pass and a second vacuum envelope member formed at the other end and having electrically insulating characteristics; an anode target arranged inside the first vacuum envelope member; a cathode arranged inside the first vacuum envelope member for releasing electrons to the anode target; a supporting member arranged inside the vacuum envelope and having one end provided with an attachment portion for being attached to an inner surface of the second vacuum envelope member and the other end supporting the anode target; a terminal substantially thermally separated from the supporting member by way of a gap and arranged for supplying a voltage to the supporting member; and a connecting portion for electrically connecting the supporting member to the terminal.

BRIEF DESCRIPTION OF THE SEVERAL VIEWS OF THE DRAWING

FIG. 1 is a cross-sectional view schematically showing the X-ray tube according to the first embodiment of the present invention.

FIG. 2 is a cross-sectional view of the X-ray tube illustrated in FIG. 1 sectioned along the line II-II.

FIG. 3 is a cross-sectional view schematically showing the X-ray tube according to the second embodiment of the present invention.

FIG. 4 is a cross-sectional view of the X-ray tube illustrated in FIG. 3 sectioned along the line IV-IV.

FIG. 5 is a cross-sectional view schematically showing the X-ray tube according to the third embodiment of the present invention.

FIG. 6 is a cross-sectional view of the X-ray tube illustrated in FIG. 5 sectioned along the line VI-VI.

FIG. 7 is a cross-sectional view schematically showing the X-ray tube according to the fourth embodiment of the present invention.

FIG. 8 is a plan view schematically showing the end surface of the attachment portion illustrated in FIG. 7.

FIG. 9 is a cross-sectional view schematically showing the X-ray tube according to the fifth embodiment of the present invention.

FIG. 10 is a cross-sectional view schematically showing the X-ray tube according to the sixth embodiment of the present invention.

FIG. 11 is a cross-sectional view schematically showing the X-ray tube according to the seventh embodiment of the present invention.

FIG. 12 is a cross-sectional view schematically showing the X-ray tube according to the eighth embodiment of the present invention.

FIG. 13 is a cross-sectional view schematically showing the X-ray tube according to the ninth embodiment of the present invention.

FIG. 14 is a cross-sectional view schematically showing the X-ray tube according to the tenth embodiment of the present invention.

DETAILED DESCRIPTION OF THE INVENTION

Fixed-anode-type X-ray tubes according to the embodiments of the present invention will be explained below with reference to the drawings.

Figure 1:
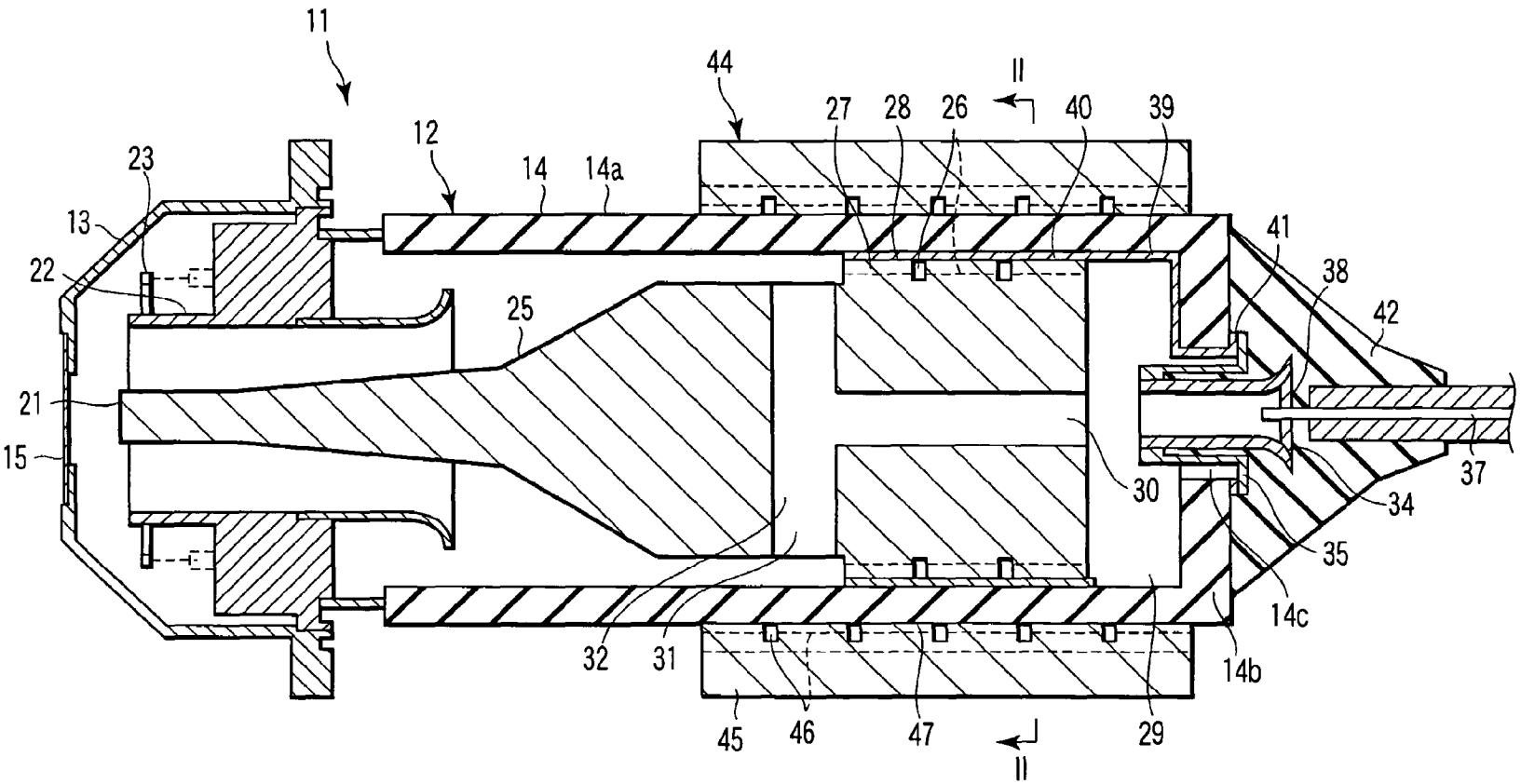
[FIG. 1]
Figure 2:
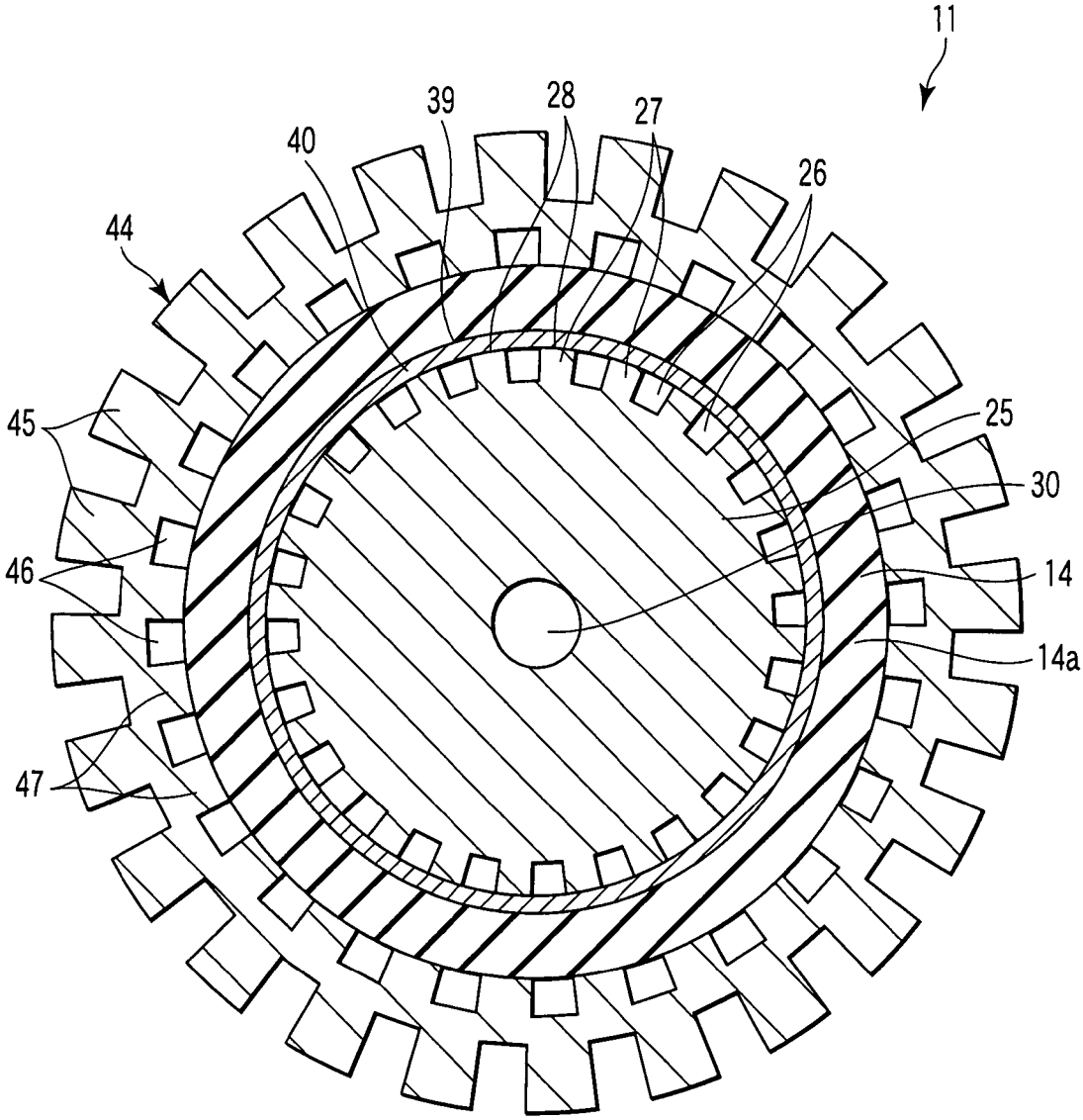
[FIG 2]

As an X-ray tube, FIGS. 1 and 2 show an X-ray tube 11 of a fixed anode type. The X-ray tube 11 comprises a vacuum envelope 12 which keeps the inside under vacuum. The vacuum envelope 12 is constituted by a first vacuum envelope member 13 that is formed of a metal and arranged at one end of the X-ray tube 11 in the shaft direction along the axis of the tube and a second vacuum envelope member 14 that is arranged at the other end and forms an insulating member.

The first vacuum envelope member 13 is formed into the shape of a cap (cylinder) in such a manner that the outer diameter of its tip gradually decreases. The tip surface of the first vacuum envelope member 13 is flattened. The flat portion is provided with an output window 15 through which X-rays pass. The output window 15 is formed of a material in which X-rays attenuate less, such as beryllium (Be), to have a thickness of tens to hundreds of micrometers.

The second vacuum envelope member 14 is formed into a close-ended cylinder by use of an insulating material prepared with an electrically insulating ceramics such as alumina. In other words, the second vacuum envelope member 14 has a cylindrical portion 14*a* one end of which is an opening for being connected to the first vacuum envelope member 13 and an end surface portion 14*b* which is the close-end portion formed on the other end of the cylindrical portion 14*a*. A mounting hole 14*c* is provided in the center of the end surface portion 14*b* to mount a terminal.

In addition, an anode target 21 is arranged inside the first vacuum envelope member 13 so as to oppose the output window 15. A focusing electrode 22 is arranged around the circumference of the anode target 21, and a cathode 23 is arranged outside the circumference of the focusing electrode 22. The cathode 23 is secured onto the external portion of the focusing electrode 22.

Moreover, a supporting member 25 is arranged in the center of the vacuum envelope 12 to support the anode target 21. The supporting member 25 is formed of a conductive material, for example, copper or a copper-base alloy, to have one end having a smaller diameter and the other end having a larger diameter. The one end is positioned inside the focusing electrode 22, with its tip supporting the anode target 21. The circumferential surface of the other end is attached to the inner circumferential surface of the cylindrical portion 14*a* of the second vacuum envelope member 14. The tip surface of the anode target 21 is coated with a tungsten layer.

The surface of the other end of the supporting member 25 is not in direct contact with the end surface portion 14*b* of the second vacuum envelope member 14, but there is a gap 29 therebetween to separate them from each other. Further, a hole portion 30 is formed along the direction of the shaft to open in the other end of the supporting member 25. In addition, a hole portion 31 is formed along the direction of the diameter at a position closer to the one end with respect to the attachment portion 28 so as to communicate with the hole portion 30. The gap 29 and the hole portions 30 and 31 create an exhaust path 32 that runs from the inside of the first vacuum envelope member 13 through the mounting hole 14*c* of the second vacuum envelope member 14.

Moreover, a tipped exhaust pipe 34 is provided in the mounting hole 14*c* formed in the end surface portion 14*b* of the second vacuum envelope member 14. The exhaust pipe 34 serves as a sealing component for vacuum-sealing after air is exhausted from the vacuum envelope 12 through the exhaust path 32 that runs inside the supporting member 25. The exhaust pipe 34 is provided with a mounting member 35, with which the exhaust pipe 34 is attached into the mounting hole 14*c* of the second vacuum envelope member 14.

Further, a high-voltage cable 37 is connected to the exhaust pipe 34 to apply a high voltage to the anode target 21. In other words, the exhaust pipe 34 serves as a sealing component to seal the vacuum envelope 12 and also has a function as a terminal 38 to which the high-voltage cable 37 is connected so as to apply a high voltage to the anode target 21. In addition, the terminal 38 is located at a position away from the attaching position of the attachment portion 28 inside the second vacuum envelope member 14.

A metalized layer 39 is formed on the second vacuum envelope member 14 to electrically connect the attachment portion 28 to the terminal 38. The metalized layer 39 is provided on the inner surface of the second vacuum envelope member 14. The metalized layer 39 includes a supporting-member-side connecting portion 40 and a terminal-side connecting portion 41. The supporting-member-side connecting portion 40 is arranged between the second vacuum envelope member 14 and the attachment portion 28 so as to make an electrical connection to the attachment portion 28. On the other hand, the terminal-side connecting portion 41 is arranged between the terminal 38 and the mounting hole 14*c* of the second vacuum envelope member 14 so as to make an electrical connection to the terminal 38.

The outer surface of the end surface portion 14*b* of the second vacuum envelope member 14, the terminal 38 and the high-voltage cable 37 are covered with an insulating material 42 made of an insulating molded resin that has insulation characteristics, such as a silicone resin.

Further, a heat dissipating member 44 that serves as a heat dissipating unit is attached onto the outer circumferential surface of the cylindrical portion 14*a* of the second vacuum envelope member 14 in such a manner as to oppose the attachment portion 28. The heat dissipating member 44 is made with a metallic material that has higher thermal conductivity than ceramics and formed into a cylindrical shape. A metalized layer, namely a metal layer film, is disposed on the outer circumferential surface of the cylindrical portion 14*a* of the second vacuum envelope member 14 as an interface between the ceramic and metallic layers, although it is not shown in the drawing, and the outer circumferential surface of the cylindrical portion 14*a* is attached to the inner surface of the heat dissipating member 44. Multiple fins 45 are arranged on the outer circumferential surface of the heat dissipating member 44 at intervals in the circumferential direction of the heat dissipating member 44 to have widths along the shaft direction of the heat dissipating member 44 in such a manner as to protrude in the direction of the external diameter.

The inner circumferential surface of the heat dissipating member 44 is formed to have projections and depressions so as to ease the thermal stress at high temperature. In other words, multiple projections 47 are formed with multiple depressions 46 formed along the shaft and circumferential directions and serving as divisions along the shaft and circumferential directions.

Moreover, the X-ray tube 11 includes a not-shown forced cooling system that forcibly cools at least the heat dissipating member 44 by use of a fluid. For this forced cooling system, air cooling which utilizes air as a fluid or liquid cooling which utilizes liquid such as an antifreeze solution that contains water as the main element may be chosen in accordance with the heat generation of the X-ray tube 11. It is preferable, however, to employ air cooling, for which operation and maintenance is easier.

Next, the operation of the X-ray tube 11 is explained with reference to FIGS. 1 and 2.

Under the operation of the X-ray tube 11, a high voltage is applied between the cathode 23 and the anode target 21 contained in the vacuum envelope 12 so that electrons are released from the cathode 23. The electrons are accelerated by a difference in potentials of the cathode 23 and the anode target 21 and collide with the anode target 21. As a result, X-rays are generated, and the generated X-rays are emitted through the output window 15.

Heat is generated by the collision of the electrons with the anode target 21, and this heat is conducted to the supporting member 25. The heat that is conducted to the supporting member 25 is transferred to the second vacuum envelope member 14 via the attachment portion 28. The heat transferred to the second vacuum envelope member 14 is transferred to the heat dissipating member 44. The heat transferred to the heat dissipating member 44 is forcefully dissipated by the fluid of the not-shown forced cooling system that acts on the heat dissipating member 44.

In the X-ray tube 11, the attachment portion 28 of the supporting member 25 is attached to the inner circumferential surface of the cylindrical portion 14*a* of the second vacuum envelope member 14. The large contact area improves the thermal conductivity from the supporting member 25 to the second vacuum envelope member 14, which increases the heat dissipating characteristics.

Furthermore, the terminal 38 is positioned away from the attachment portion 28, in other words, on the end surface portion 14*b* of the second vacuum envelope member 14. Thus, the temperature of the insulating material 42 that surrounds this terminal 38 by means of insulation-molding can be kept low, and the insulating characteristics can be ensured over the long term.

The supporting member 25 and the terminal 38 are not brought into direct contact with each other, but are separated by the gap 29 that are provided therebetween. However, the supporting member 25 and the terminal 38 are electrically connected to each other by the metalized layer 39 deposited on the second vacuum envelope member 14.

In addition, the terminal 38 is constituted by the exhaust pipe 34 which also serves as a vacuum-sealing component for the vacuum envelope 12. This reduces the number of components and thereby simplifies the structure.

Further, the surface of the supporting member 25 in the vicinity of the attachment portion 28 is designed to have projections and depressions, and the attachment portion 28 is constituted by the projections 27. Thus, the thermal expansion of the supporting member 25 produced by high temperature is absorbed by elastic deformation of the projection-depression portion, and the thermal stress can be thereby eased.

Similarly, the inner circumferential surface of the heat dissipating member 44 is designed to have projections and depressions. Thus, the thermal expansion of the heat dissipating member 44 produced by high temperature is absorbed by elastic deformation of the projection-depression portion, and the thermal stress can be thereby eased.

Further, the heat dissipating member 44, which is formed with a metallic material that has higher thermal conductivity than ceramics, has excellent heat dissipating characteristics. Moreover, because of the multiple fins 45 arranged on the outer circumferential surface of the heat dissipating member 44, the heat dissipating member 44 has a large surface area, which improves the heat dissipating characteristics.

In addition, the not-shown forced cooling system forcefully cools the outer circumferential surface of the second vacuum envelope member 14 by means of a fluid. The heat dissipating characteristics of this forced cooling system can be further improved by the heat dissipating member 44.

Figure 3:
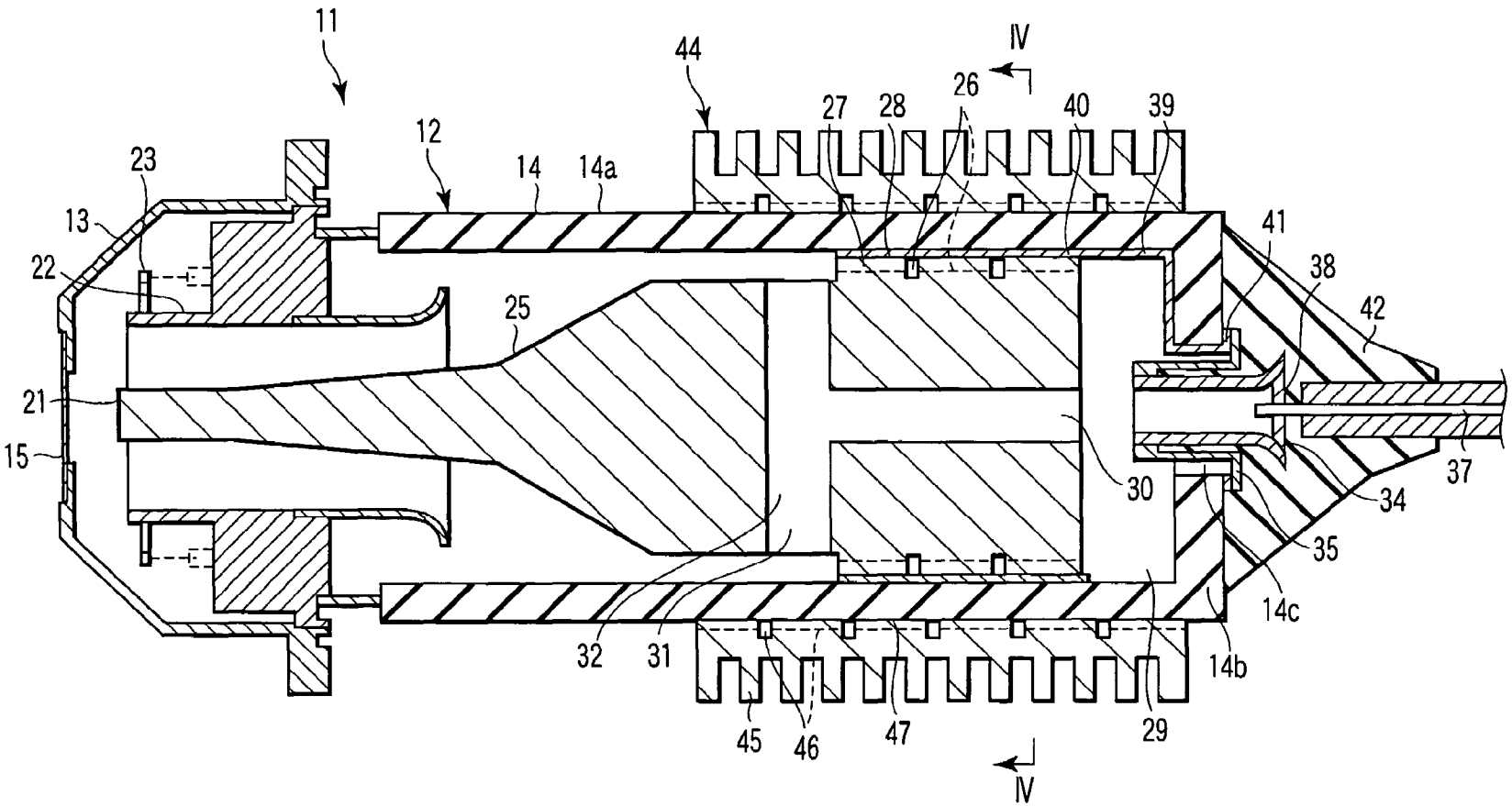
[FIG. 3]
Figure 4:
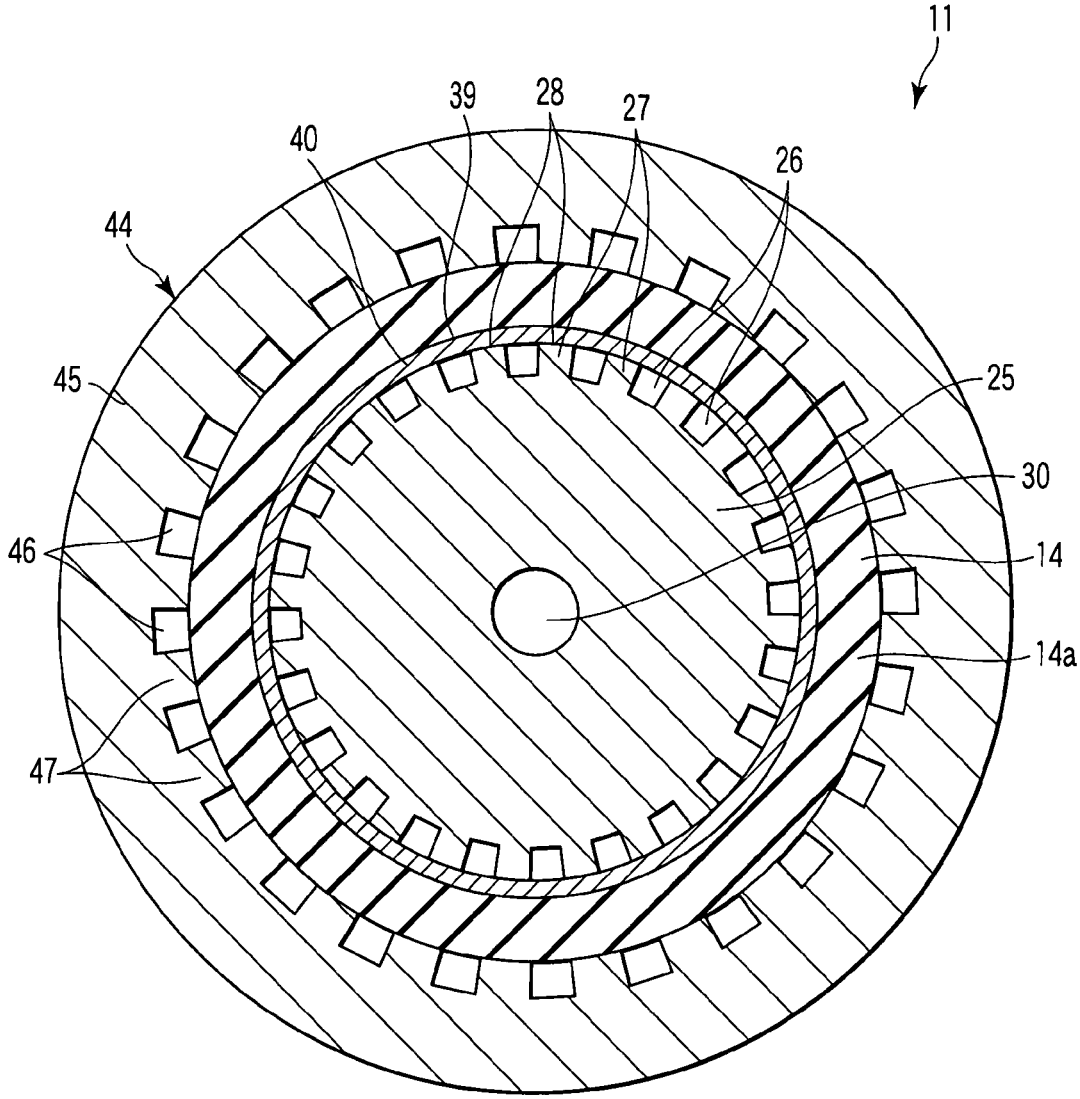
[FIG. 4]

Next, FIGS. 3 and 4 illustrate an X-ray tube according to the second embodiment of the present invention.

In FIGS. 3 and 4, the elements the same as those in FIGS. 1 and 2 are provided with the same reference numbers, and the explanation thereof is omitted.

Multiple fins 45 are provided circularly on the outer circumferential surface of the heat dissipating member 44 along the circumferential direction of the heat dissipating member 44 at intervals in the shaft direction of the heat dissipating member 44 in such a manner as to protrude in the direction of the outer diameter. In such a cooling structure, the heat dissipating member 44 is designed to have a large surface area, which increases the heat dissipating characteristics.

Figure 5:
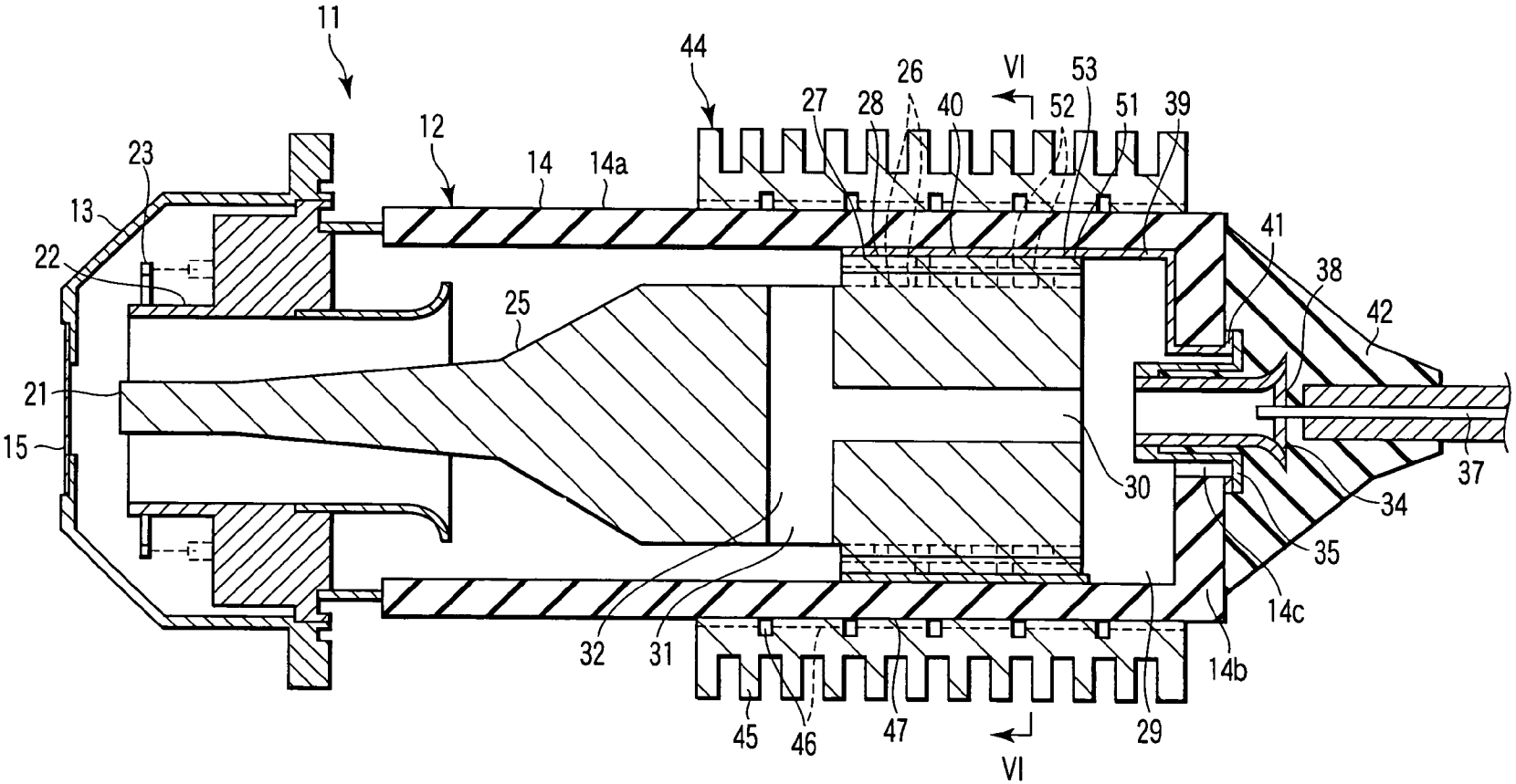
[FIG. 5]
Figure 6:
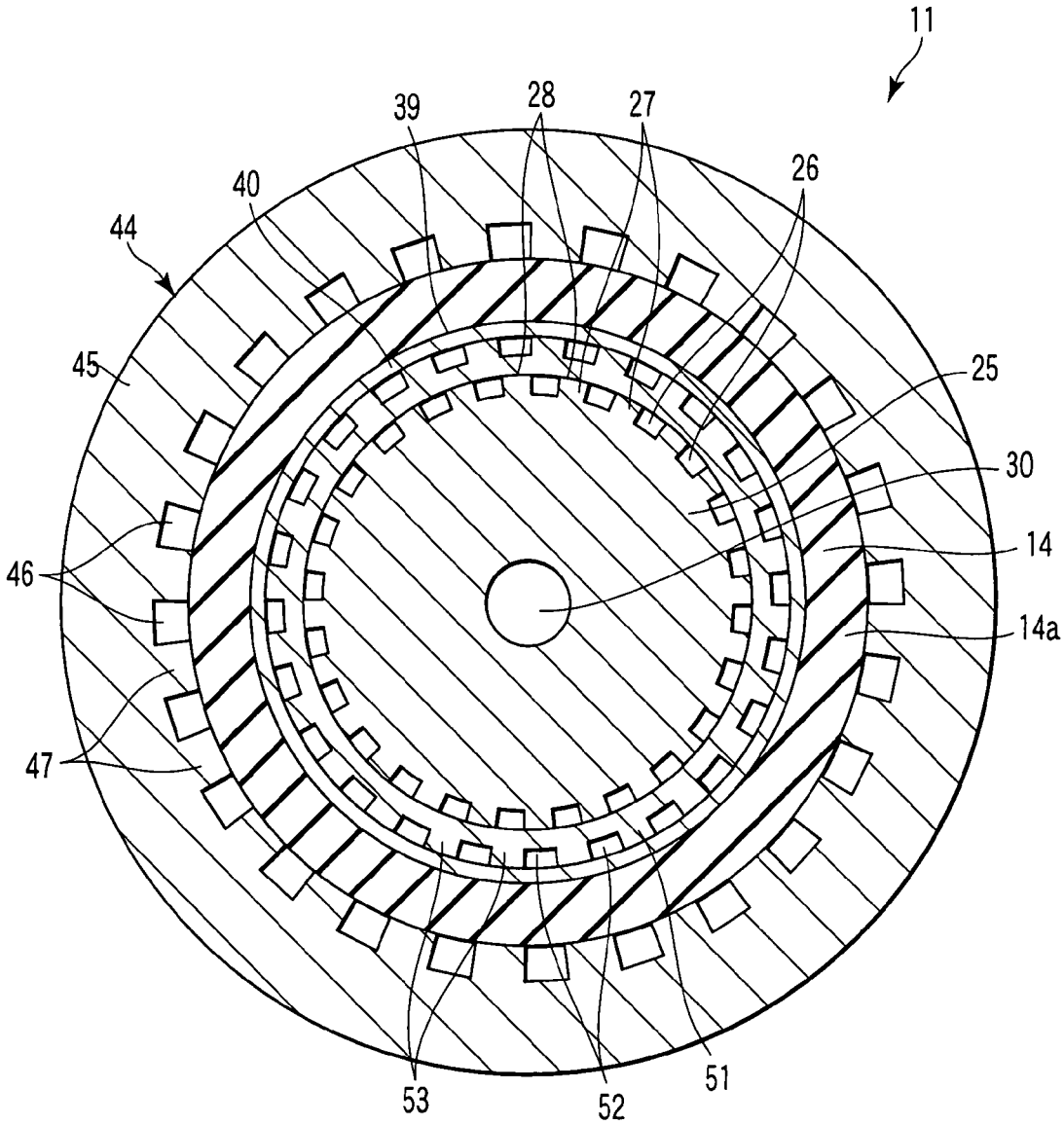
[FIG. 6]

Next, FIGS. 5 and 6 illustrate an X-ray tube according to the third embodiment of the present invention.

In a similar manner to the explanation of FIGS. 3 and 4, the elements in FIGS. 5 and 6 that are the same as those in FIGS. 1 and 2 are provided with the same reference numbers, and the explanation thereof is omitted.

A flexible component 51 that is formed of a metal into a shape of a cylinder is arranged between the attachment portion 28 and the inner circumferential surface of the cylindrical portion 14*a* of the second vacuum envelope member 14. The inner circumferential surface of the flexible component 51 is designed to be a curved surface without any projections or depressions. On the other hand, the outer circumferential surface of the flexible component 51 is designed to have projections and depressions in order to ease the thermal stress caused by the thermal expansion at high temperature. In other words, multiple projections 53 are formed by the multiple depressions 52 formed along the shaft direction and the circumferential direction and serving as divisions in the shaft direction and the circumferential direction. The surfaces of the projections 53 are attached to the inner circumferential surface of the cylindrical portion 14*a* of the second vacuum envelope member 14.

Heat is conducted from the attachment portion 28 to the second vacuum envelope member 14 via the flexible component 51. Furthermore, the thermal expansion of the supporting member 25 produced at high temperature is absorbed by the elastic deformation of the flexible component 51, and the thermal stress is thereby eased.

Figure 7:
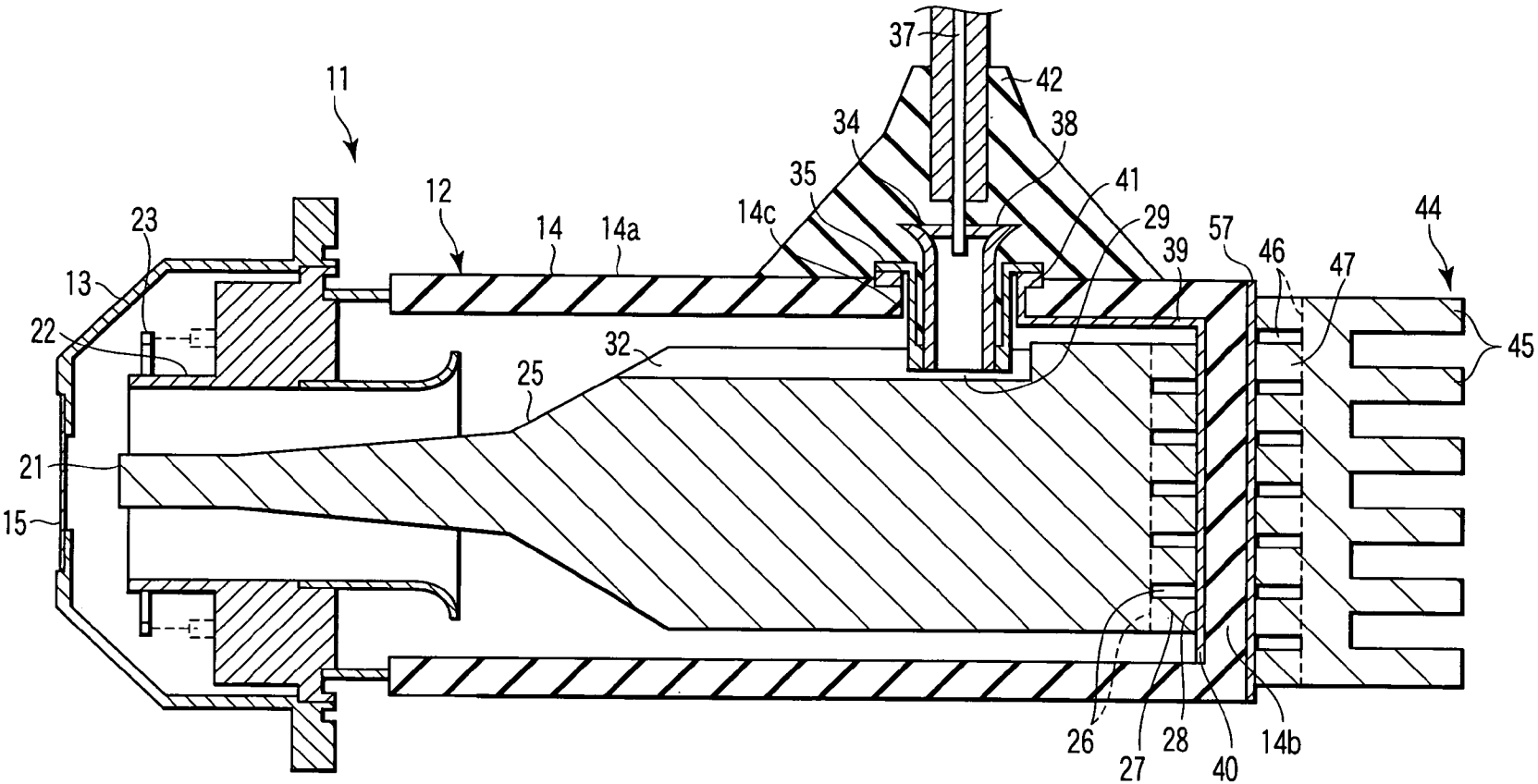
[FIG. 7]
Figure 8:
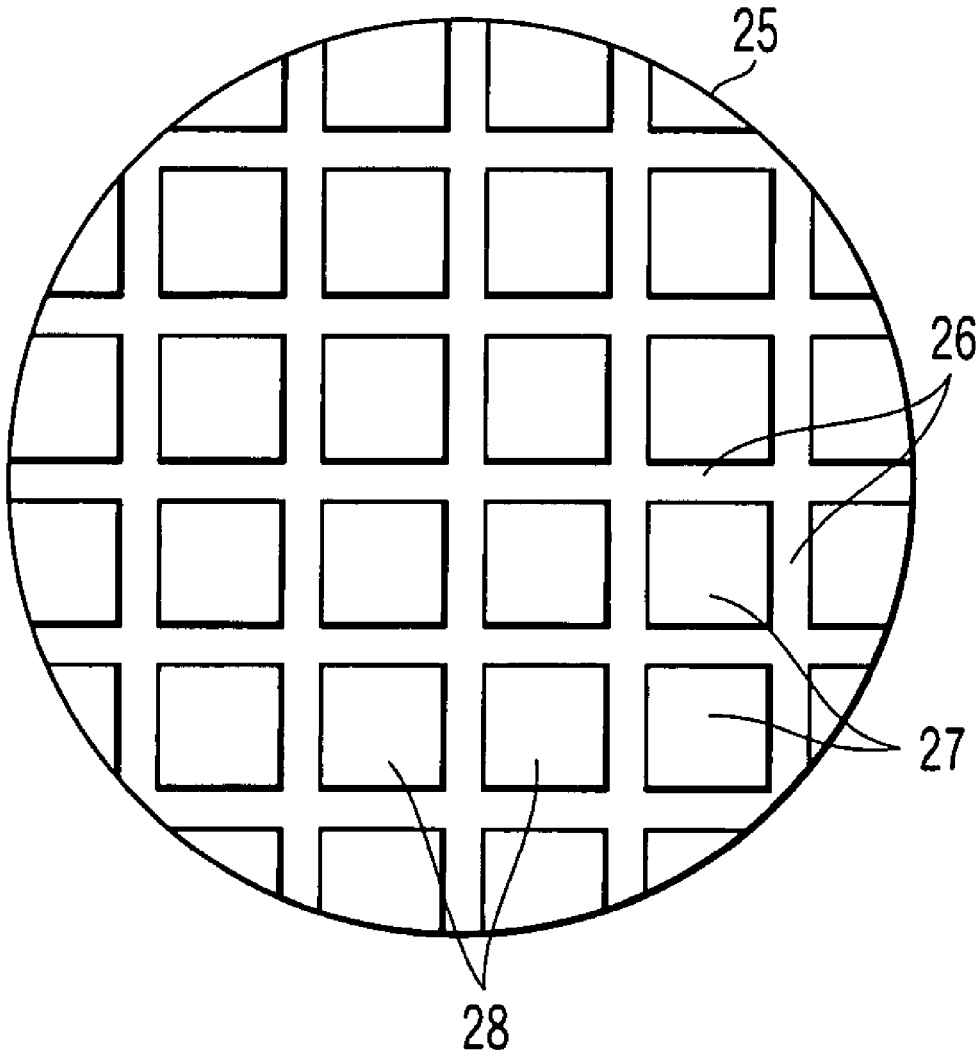
[FIG. 8]

Next, FIGS. 7 and 8 show an X-ray tube according to the fourth embodiment of the present invention.

The elements in FIGS. 7 and 8 that are the same as those in FIG. 1 are provided with the same reference numbers, and the explanation thereof is omitted.

The other end of the supporting member 25 is connected to the inner surface of the end surface portion 14*b* of the second vacuum envelope member 14. The surface of the other end of the supporting member 25 is designed to have projections and depressions so as to ease thermal stress at high temperature. In other words, as illustrated in FIG. 8, multiple projections 27 are formed with multiple depressions 26 formed into a grid and serving as a division. The surfaces of the multiple projections 27 are configured to function as an attachment portion 28 which is attached to the inner surface of the end surface portion 14*b* of the second vacuum envelope member 14. Furthermore, an exhaust path 32 is formed on the circumferential surface portion of the supporting member 25 along the shaft direction thereof.

In addition, a mounting hole 14*c* is formed in the cylindrical portion 14*a* of the second vacuum envelope member 14. A tipped exhaust pipe 34, which functions as a vacuum-sealing component and a terminal 38, is attached the mounting hole 14*c*. A high-voltage cable 37 is connected to the exhaust pipe 34. The terminal 38 is arranged sufficiently away from the position where the attachment portion 28 is attached to the second vacuum envelope member 14.

A metalized layer 39 is formed on the second vacuum envelope member 14 to electrically connect the attachment portion 28 to the terminal 38. The metalized layer 39 is deposited on the inner surface of the second vacuum envelope member 14. The metalized layer 39 includes a supporting-body-side connecting portion 40 and a terminal-side connecting portion 41. The supporting-body-side connecting portion 40 is positioned between the second vacuum envelope member 14 and the attachment portion 28 to make an electrical connection to the attachment portion 28. On the other hand, the terminal-side connecting portion 41 is positioned between the terminal 38 and the mounting hole 14*c* of the second vacuum envelope member 14 to make an electrical connection to the terminal 38.

The outer surface of the cylindrical portion 14*a* of the second vacuum envelope member 14, the terminal 38, the high-voltage cable 37 and the like are coated with an insulating material 42.

Moreover, one end of the heat dissipating member 44 is connected by means of soldering 57 to the outer surface of the end surface portion 14*b* of the second vacuum envelope member 14 which opposes the attachment portion 28. Multiple fins 45 are provided on the other end of the heat dissipating member 44 in such a manner as to protrude toward the outside. The surface of the one end of the heat dissipating member 44 is designed to have projections and depressions in order to ease thermal stress at high temperature. In other words, multiple projections 47 are defined by multiple depressions 46 that are formed into a grid and serve as a division. In addition, the X-ray tube 11 includes a not-shown forced cooling system that forcefully cools the heat dissipating member 44 by use of a fluid.

During the operation of the X-ray tube 11, a high voltage is applied between the cathode 23 and the anode target 21 contained in the vacuum envelope 12 so that electrons are released from the cathode 23. These electrons are accelerated by a difference in potentials of the cathode 23 and the anode target 21 and collide with the anode target 21, and as a result, X-rays are emitted. The X-rays are released through the output window 15.

When the electrons collide with the anode target 21, heat is generated. This heat is transferred to the supporting member 25. The heat transferred to the supporting member 25 is conducted to the second vacuum envelope member 14 by way of the attachment portion 28. The heat conducted to the second vacuum envelope member 14 is conducted to the heat dissipating member 44. The heat conducted to the heat dissipating member 44 is forced dissipated by the fluid of the not-shown forced cooling system that acts on the heat dissipating member 44.

The X-ray tube 11, in which the attachment portion 28 is attached to the inner surface of the end surface portion 14*b* of the second vacuum envelope member 14, has a large contact area. Thus, thermal conductivity from the supporting member 25 to the second vacuum envelope member is kept high, and the heat dissipating characteristics is improved.

Furthermore, the terminal 38 is arranged away from the attachment portion 28, in other words, on the cylindrical portion 14*a* of the second vacuum envelope member 14. Thus, the temperature of the insulating material 42 that surrounds the terminal 38 by means of insulation molding can be kept low, and the insulation characteristics can be ensured over the long term.

The supporting member 25 and the terminal 38 are positioned away from each other with the gap 29 therebetween, but are electrically connected by means of the metalized layer 39.

Further, the terminal 38 is constituted by the exhaust pipe 34 which also serves as a vacuum-sealing component for the vacuum envelope 12. Thus, the number of components is reduced, and the structure is simplified.

Furthermore, the surface of the supporting member 25 attached to the inner surface of the end surface portion 14*b* of the second vacuum envelope member 14 is designed to have projections and depressions in the vicinity of the attachment portion 28. The attachment portion 28 is defined by the projections 27. The thermal expansion of the supporting member 25 produced at high temperature is absorbed by the elastic deformation of this projection-depression portion, and the thermal stress is thereby eased.

Similarly, the surface of the one end of the heat dissipating member 44 is designed to have projections and depressions. Hence, the thermal expansion of the heat dissipating member 44 produced at high temperature is absorbed by the elastic deformation of the projection-depression portion, and the thermal stress is thereby eased.

Further, as described above, the heat dissipating member 44, which is made of a metallic material that has higher thermal conductivity than ceramics, is excellent in heat dissipating characteristics. In addition, because of the multiple fins 45 arranged on the other end of the heat dissipating member 44, the heat dissipating member 44 is provided with a large surface area, which increases the heat dissipating characteristics. Still further, the not-shown forced cooling system forcefully cools the heat dissipating member 44 by means of a fluid.

Figure 9:
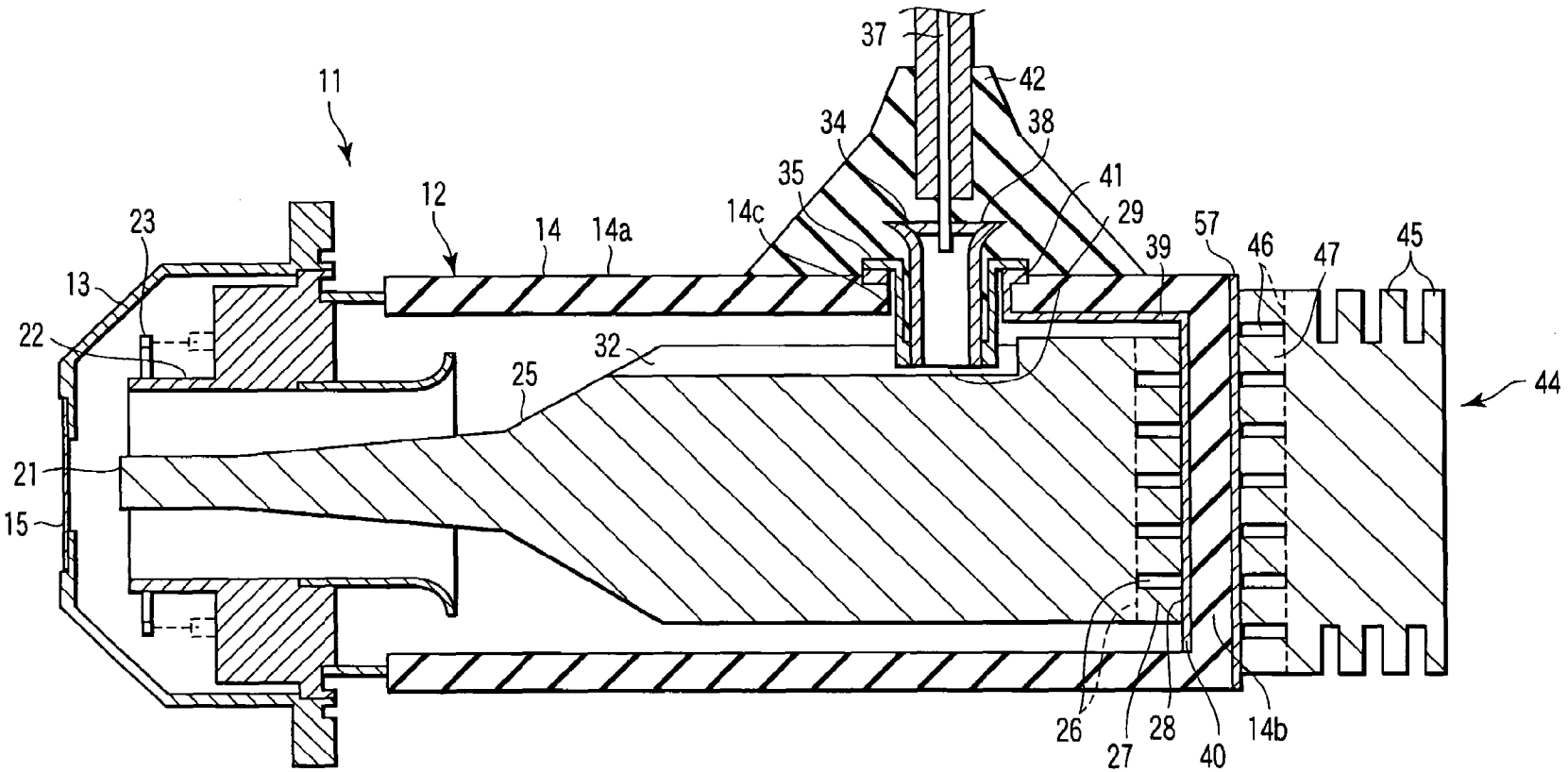
[FIG. 9]

Next, FIG. 9 illustrates an X-ray tube according to the fifth embodiment of the present invention.

Any elements in FIG. 9 that are the same as those in FIG. 7 are provided with the same reference numbers, and the explanation thereof is omitted.

The basic structure of the X-ray tube 11 where the attachment portion 28 is attached to the inner surface of the end surface portion 14*b* of the second vacuum envelope member 14 is the same as the structure of the fourth embodiment.

Multiple fins 45 are arranged on the outer circumferential surface of the heat dissipating member 44 in the circumferential direction of the base portion of the heat dissipating member 44 to protrude in the direction of the outer diameter. The fins 45 are formed circularly around the circumference of the base of the heat dissipating member 44 and positioned at intervals along the shaft direction of the heat dissipating member 44. In such as structure, the heat dissipating member 44 is provided with a large surface area, and the heat dissipating characteristics are thereby further improved.

Figure 10:
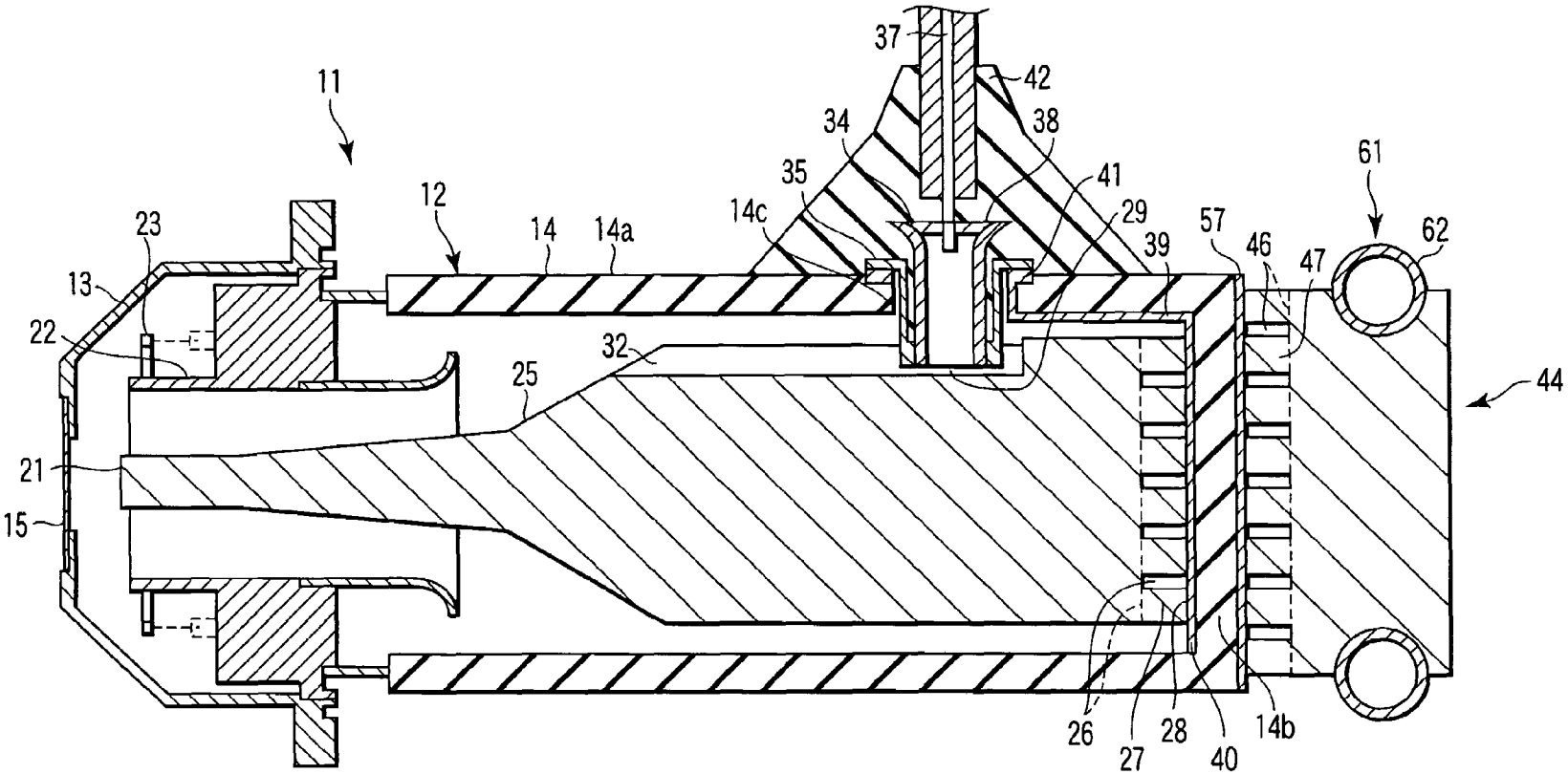
[FIG. 10]

Next, FIG. 10 illustrates an X-ray tube according to the sixth embodiment of the present invention.

Any elements in FIG. 10 that are the same as those in FIG. 7 are provided with the same reference numbers, and the explanation thereof is omitted. The basic structure of the X-ray tube where the attachment portion 28 is attached to the inner surface of the end surface portion 14*b* of the second vacuum envelope member 14 is the same as the structure of the fourth embodiment.

In the forced cooling system 61 that cools the heat dissipating member 44, a pipe 62 through which a fluid flows is connected to the base of the heat dissipating member 44. When liquid such as an antifreeze solution or the like that contains water as the main element is supplied as a fluid so as to flow through the pipe 62, heat conducted to the heat dissipating member 44 is forcefully cooled by heat exchange with the liquid through the pipe 62. The forced cooling system 61 that adopts liquid for the fluid improves the heat dissipating characteristics.

Figure 11:
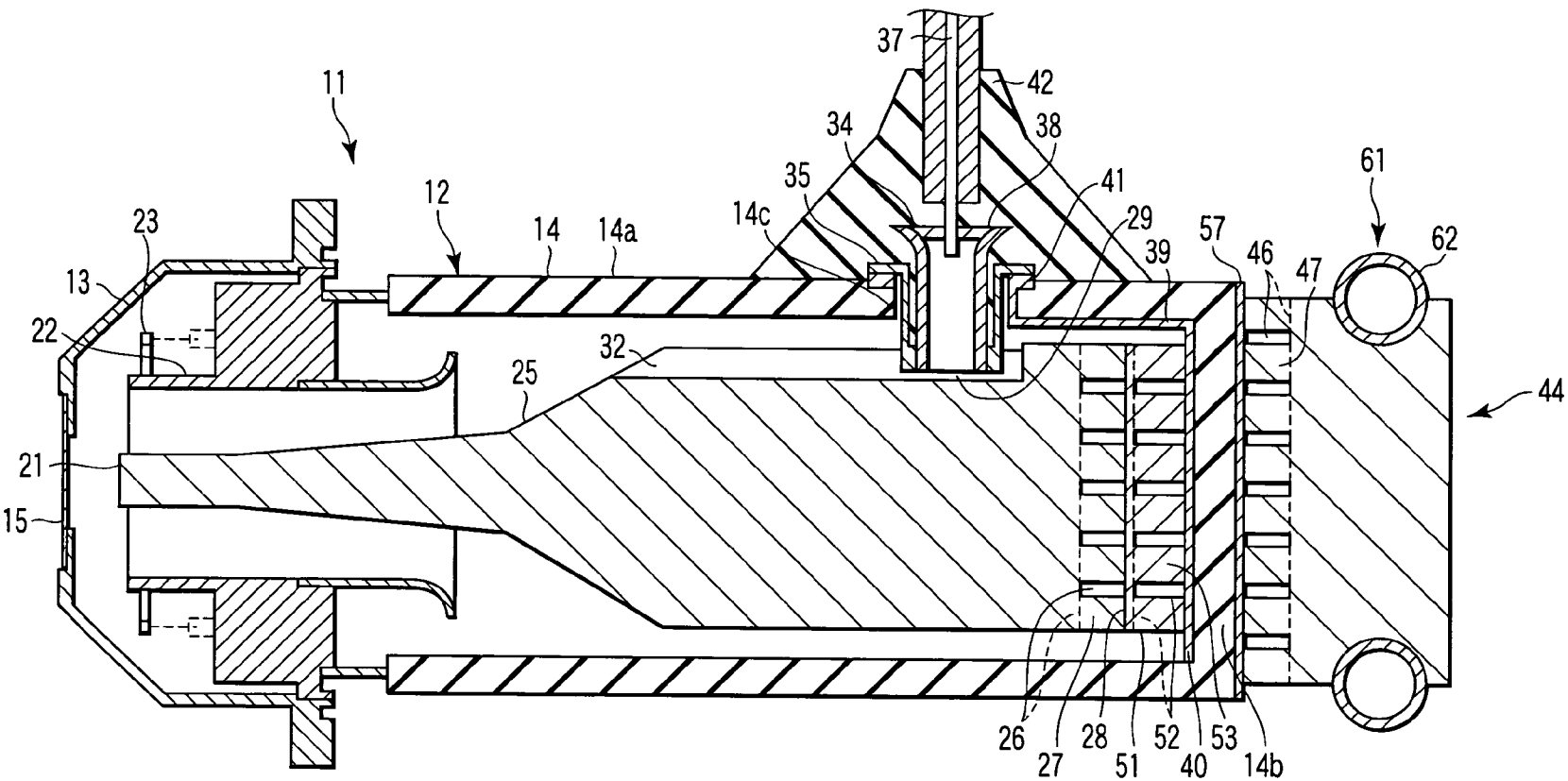
[FIG. 11]

Next, FIG. 11 illustrates an X-ray tube according to the seventh embodiment of the present invention.

Any elements in FIG. 11 that are the same as those in FIG. 10 are provided with the same reference numbers, and the explanation thereof is omitted. The basic structure of the X-ray tube where the attachment portion 28 is attached to the inner surface of the end surface portion 14*b* of the second vacuum envelope member 14, as well as the forced cooling system 61, is the same as the sixth embodiment.

The attachment portion 28 and the inner surface of the end surface portion 14*b* of the second vacuum envelope member 14 are connected to each other by way of a flexible component 51 arranged therebetween, which is formed of a metal disk. The surface of one end of the flexible component 51 attached to the attachment portion 28 is designed to be a curved surface without any projections or depressions. On the other hand, the surface of the other end of the flexible component 51 attached to the inner surface of the end surface portion 14*b* of the second vacuum envelope member 14 is designed to have projections and depressions to ease the thermal stress produced at high temperature. In other words, multiple projections 53 are defined by multiple depressions 52 that are formed into a grid and serve as a division. The surfaces of these projections 53 are attached to the inner surface of the end surface portion 14*b* of the second vacuum envelope member 14.

Heat is conducted from the attachment portion 28 to the second vacuum envelope member 14 by way of the flexible component 51 arranged between the attachment portion 28 and the inner surface of the end surface portion 14*b* of the second vacuum envelope member. Further, the thermal expansion of the supporting member 25 produced at high temperature is absorbed by the elastic deformation of the flexible component 51, and the thermal stress is thereby eased.

Figure 12:
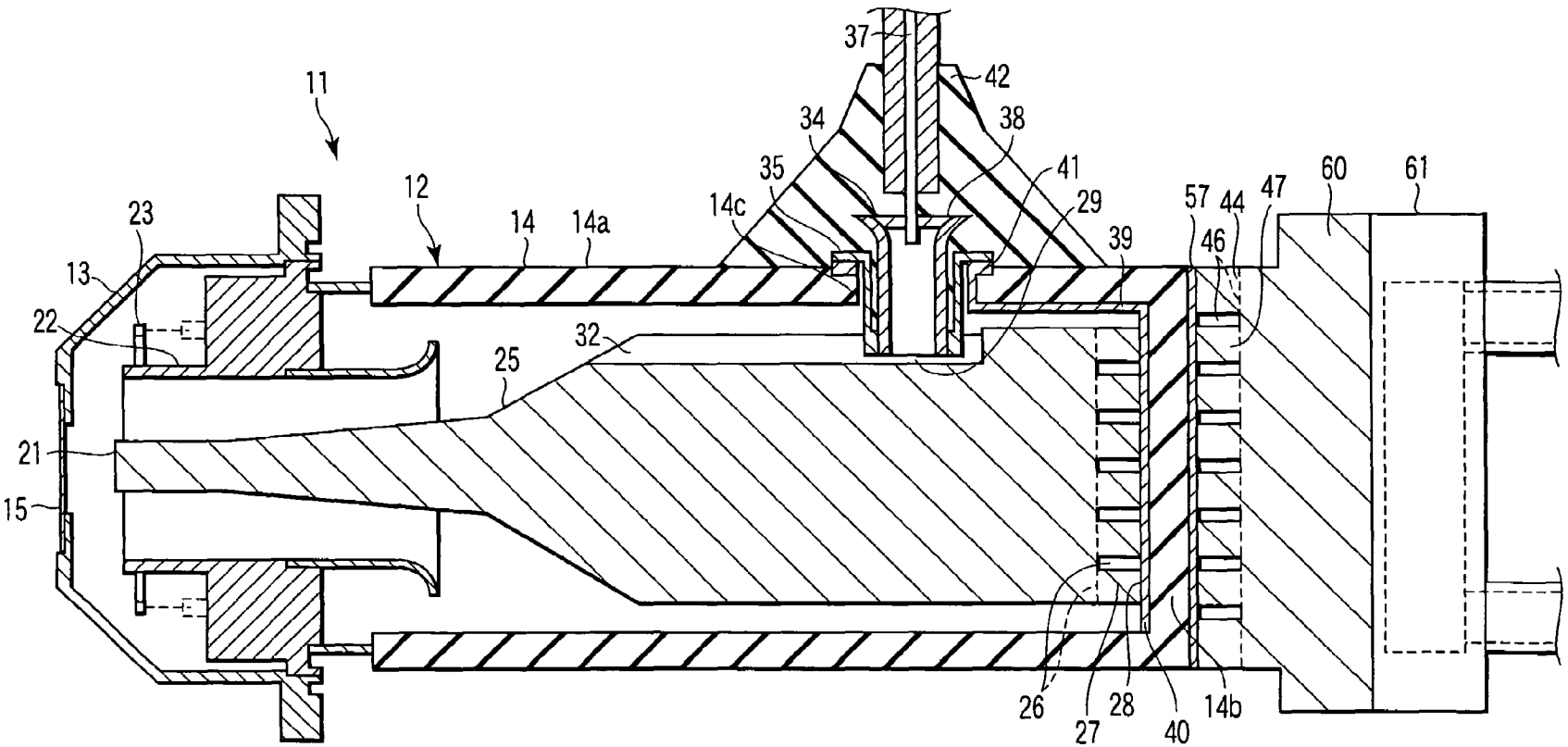
[FIG. 12]

Next, FIG. 12 illustrates an X-ray tube according to the eighth embodiment of the present invention.

Any elements in FIG. 12 that are the same as those in FIG. 7 are provided with the same reference numbers, and the explanation thereof is omitted. The basic structure of the X-ray tube 11 where the attachment portion 28 is attached to the inner surface of the end surface portion 14*b* of the second vacuum envelope member 14 is the same as the fourth embodiment.

As illustrated in FIG. 12, the heat dissipating member 44 is fixed to the base 60 in an integrated fashion. To this base 60, the forced cooling system 61 that cools the heat dissipating unit 44 is detachably fixed to the base 60 by means of screws. This forced cooling system 61 further improves the heat dissipating characteristics. In addition, the forced cooling system 61, which is secured by screws, can be readily detached and replaced.

Figure 13:
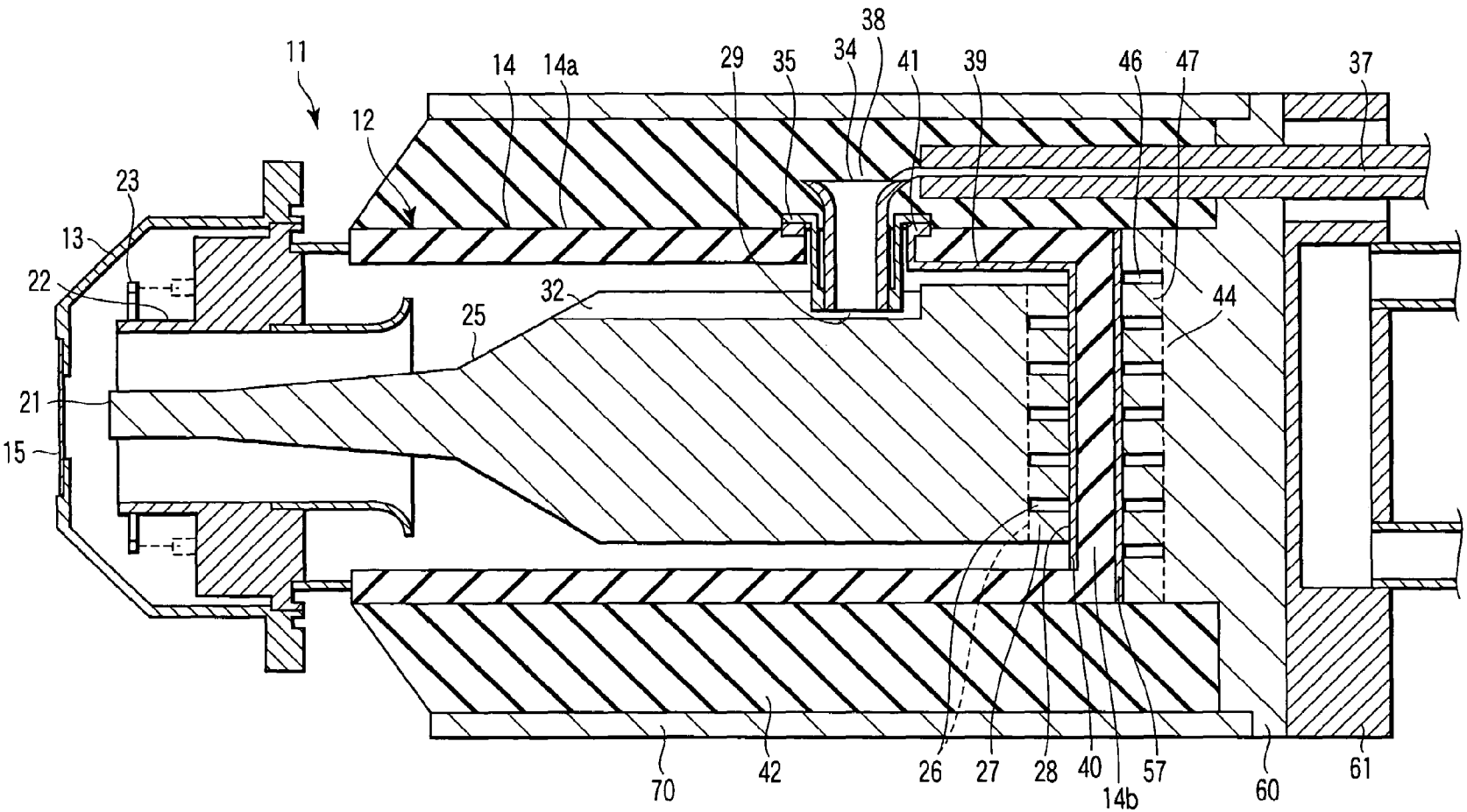
[FIG. 13]

Next, FIG. 13 illustrates an X-ray tube according to the ninth embodiment of the present invention.

Any elements in FIG. 13 that are the same as those in FIG. 12 are provided with the same reference numbers, and the explanation thereof is omitted. The basic structure of the X-ray tube 11 where the attachment portion 28 is attached to the inner surface of the end surface portion 14*b* of the second vacuum envelope member 14, as well as the forced cooling system 61, is the same as the eighth embodiment. In a similar manner to the structure illustrated in FIG. 13, the forced cooling system 61 is detachably fixed to the base 60 by means of screws.

A metal cylinder 70 is secured to the base 60 in such a manner as to cover the outer circumference of the second vacuum envelope member 14. An insulating material 42 is arranged between the metal cylinder 70 and the outer circumference of the second vacuum envelope member 14, and the entire outer circumference of the cylindrical portion 14*a* of the second vacuum envelope member 14, the terminal 38, the high-voltage cable 37 and the like are covered with the insulating material 42. In such a structure where the entire outer circumference of the cylindrical portion 14*a* of the second vacuum envelope member 14 is covered with the insulating material 42, excellent insulating characteristics can be realized. For the insulating material 42, a material in which alumina or aluminum nitride is mixed into a silicone resin is used.

Figure 14:
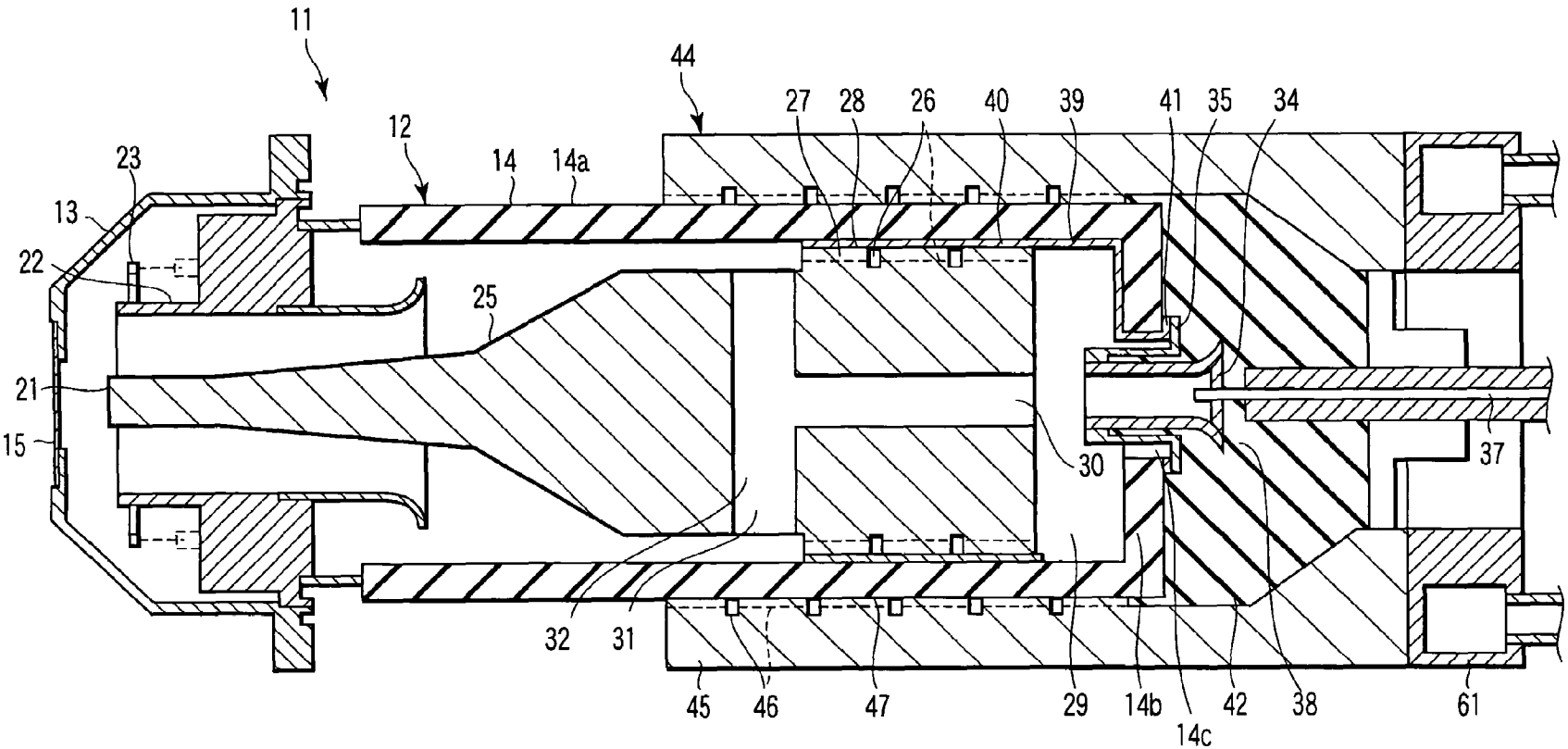
[FIG. 14]

Next, FIG. 14 illustrates an X-ray tube according to the tenth embodiment of the present invention.

Any elements in FIG. 14 that are the same as those in FIG. 1 are provided with the same reference numbers, and the explanation thereof is omitted. The basic structure of the X-ray tube 11 where the attachment portion 28 is attached to the inner surface of the cylindrical portion 14*a* of the second vacuum envelope member 14 is the same as the first embodiment.

One end of the heat dissipating unit 44 is connected to the cylindrical portion 14*a* of the second vacuum envelope member 14. Moreover, the other end of the heat dissipating member 44 is extended so as to cover the insulating material 42, and the base 60 is arranged on the other end. The forced cooling system 61 is secured to the base 60 by means of screws.

According to the present embodiment, the insulating material 42 can dissipate heat by means of the heat dissipating member 44. Thus, the heat dissipating characteristics can be improved, and the insulating characteristics can be ensured over the long term. Especially because the heat dissipating unit 44 is cooled directly by the forced cooling system 61, the X-ray tube can be efficiently cooled. Furthermore, the forced cooling system 61 that is secured by screws can be readily detached and replaced.

It should be noted that the present invention is not limited to the above embodiments, but may be realized by modifying the structural elements without departing from the gist at the stage of implementation. Moreover, by suitably combining structural elements disclosed in the above embodiments, various inventions can be attained. In addition, a structure in which, for instance, some structural elements are omitted from the elements of the entire structure indicated in any of the embodiments is conceivable. Further, the structural embodiments described in different embodiments may be suitably combined.

Of course, in addition to the above, the present invention can be realized by making various modifications without departing from the gist of the present invention.

The present invention offers an X-ray tube that maintains excellent heat dissipating characteristics and ensures the insulating characteristics of the insulating material over the long term.

What is claimed is:

1. An X-ray tube comprising:

a cylindrical vacuum envelope including a first outer casing member formed at one end of the cylindrical vacuum envelope and provided with an output window through which X-rays pass, and a second outer casing member formed at the other end of the cylindrical vacuum envelope and having electrically insulating characteristics;

an anode target arranged inside the first outer casing member;

a cathode arranged inside the first outer casing member for releasing electrons to the anode target;

a supporting member arranged inside the cylindrical vacuum envelope, with a gap provided between the supporting member and an end portion of the second outer casing member, and having one end of the supporting member provided with an attachment portion for being attached to an inner surface of a cylindrical portion of the second outer casing member and the other end of the supporting member being smaller in diameter than said one end of the supporting member and supporting the anode target;

a terminal provided in the end portion of the second outer casing member, substantially thermally separated from the supporting member by way of the gap and arranged for supplying a voltage to the supporting member;

an insulating mold resin which covers an outer periphery of the terminal; and a connecting portion for electrically connecting the supporting member to the terminal.

2. The X-ray tube according to claim 1, wherein, the connecting portion is a metalized layer formed on the inner surface of the second outer casing member.

3. The X-ray tube according to claim 1, further comprising: a heat dissipating member arranged on the cylindrical portion of the second outer casing member for dissipating heat that is generated at the anode target and conducted by means of the supporting member, to outside.

4. The X-ray tube according to claim 1, wherein, the terminal further includes a sealing portion for vacuum-sealing the cylindrical vacuum envelope.

5. The X-ray tube according to claim 1, wherein, part of a surface of the supporting member is designed to have projections and depressions, and the attachment portion includes a portion that has the projections.

6. The X -ray tube according to claim 1, further comprising: a flexible component arranged between the attachment portion and the second outer casing member.

7. The X-ray tube according to claim 1, further comprising: a cooling system that cools an outer surface of the second outer casing member by means of a fluid.

8. An X-ray tube comprising:

a cylindrical vacuum envelope including a first outer casing member formed at one end of the cylindrical vacuum envelope and provided with an output window through which X-rays pass, and a second outer casing member formed at the other end of the cylindrical vacuum envelope and having electrically insulating characteristics;

an anode target arranged inside the first outer casing member;

a cathode arranged inside the first outer casing member for releasing electrons to the anode target;

a supporting member arranged in the cylindrical vacuum envelope, with a gap provided between the supporting member and a cylindrical portion of the second outer casing member, and having one end of the supporting member provided with an attachment portion for being attached to an inner surface of an end portion of the second outer casing member and the other end of the supporting member being smaller than said one end of the supporting member and supporting the anode target;

a terminal provided in the cylindrical portion of the second outer casing member, substantially thermally separated from the supporting member by way of the gap and arranged for supplying a voltage to the supporting member;

an insulating mold resin which covers an outer periphery of the terminal; and a connecting portion for electrically connecting the supporting member to the terminal.

9. The X-ray tube according to claim 8, wherein, the connecting portion is a metalized layer formed on the inner surface of the second outer casing member.

10. The X-ray tube according to claim 8, further comprising: a heat dissipating member arranged on the end portion of the second outer casing member for dissipating heat that is generated at the anode target and conducted by means of the supporting member, to outside.

11. The X-ray tube according to claim 8, wherein, the terminal further includes a sealing portion for vacuum-sealing the cylindrical vacuum envelope.

12. The X-ray tube according to claim 8, wherein, part of a surface of the supporting member is designed to have projections and depressions, and the attachment portion includes a portion that has the projections.

13. The X-ray tube according to claim 8, further comprising: a flexible component arranged between the attachment portion and the second outer casing member.

14. The X-ray tube according to claim 8, further comprising: a cooling system that forcefully cools an outer surface of the second outer casing member by means of a fluid.

* * * * *